United States Patent [19]

Hoshi

[11] Patent Number: 4,984,509

[45] Date of Patent: Jan. 15, 1991

[54] MULTISTAGE CYLINDER ACTUATOR

[76] Inventor: Hideo Hoshi, 19-14, Maru-no-uchi 3-chome, Naka-Ku, Nagoya-shi, Aichi-ken, Japan

[21] Appl. No.: 360,181

[22] Filed: Jun. 1, 1989

[30] Foreign Application Priority Data

Jun. 20, 1988 [JP] Japan ..... 63-152012

[51] Int. Cl.[5] ..... F01B 13/00

[52] U.S. Cl. ..... 92/107; 92/61

[58] Field of Search ..... 92/61, 107, 108

[56] References Cited

U.S. PATENT DOCUMENTS

| | | | |
|---|---|---|---|
| 2,734,494 | 2/1956 | Waterval | 92/107 X |
| 4,424,012 | 1/1984 | Westmoreland | 92/107 X |
| 4,531,451 | 7/1985 | Mouton | 92/108 |

*Primary Examiner*—William E. Wayner

*Attorney, Agent, or Firm*—Armstrong, Nikaido, Marmelstein, Kubovcik & Murray

[57] ABSTRACT

A multistage cylinder actuator comprising a center cylinder unit and annular auxiliary cylinder units which are concentrically located around the center cylinder and which are removably attached to a common plate so as to independently operate.

10 Claims, 3 Drawing Sheets

MULTISTAGE CYLINDER ACTUATOR

BACKGROUND OF THE INVENTION

1. Field of the Invention

The present invention relates to a cylinder actuator more precisely it relates to a multistage cylinder actuator.

2. Description of the Related Art

A cylinder actuator usually has a single cylinder in which a piston reciprocally moves. A multistage cylinder actuator is also known, which has a main cylinder and one or more than one auxiliary cylinder or cylinders. In this multistage cylinder device which is used as an actuator, a plurality of cylinders which are arranged side by side must be operated in a predetermined sequence. However, such a multistage cylinder actuator is large and complex in operation.

The primary object of the present invention is therefore to provide a small and simple multistage cylinder actuator in which a plurality of operations can be sequentially effected and in which a center main cylinder is surrounded by auxiliary cylinders.

SUMMARY OF THE INVENTION

To achieve the object mentioned above, according to the present invention, there is provided a multistage cylinder actuator comprising a center cylinder and at least one annular auxiliary cylinder which is concentrically located around the center cylinder and which is removably attached to a common plate so as to independently operate.

With this arrangement, the center cylinder and the annular auxiliary cylinders surrounding the center cylinder are concentrically connected to the common plate. In theory, there is no limitation to the number of the annular auxiliary cylinders concentrically provided around the center cylinder.

Furthermore, since the center cylinder and the auxiliary annular cylinders are independently and detachably connected to the common plate, it is not always necessary to assemble the auxiliary annular cylinders in a specific order. Namely, an outer auxiliary cylinder can be attached to the common plate before an inner auxiliary cylinder is attached thereto. It is possible to independently attach and detach any auxiliary cylinder to and from the common plate. It is also possible to remove the center cylinder, if unnecessary.

Since the operations of the cylinders are independently of each other, the directions of the operations of the cylinders can be optionally selected. The fluid (hydraulic or pneumatic) pressure of the working fluid of the cylinders can be optionally determined and adjusted. The operational sequence of the cylinders can be also optionally determined and adjusted.

BRIEF DESCRIPTION OF THE DRAWINGS

The invention will be described below in detail with reference to the accompanying drawings, in which.

DETAILED DESCRIPTION OF THE PREFERRED EMBODIMENTS

Figure 1:
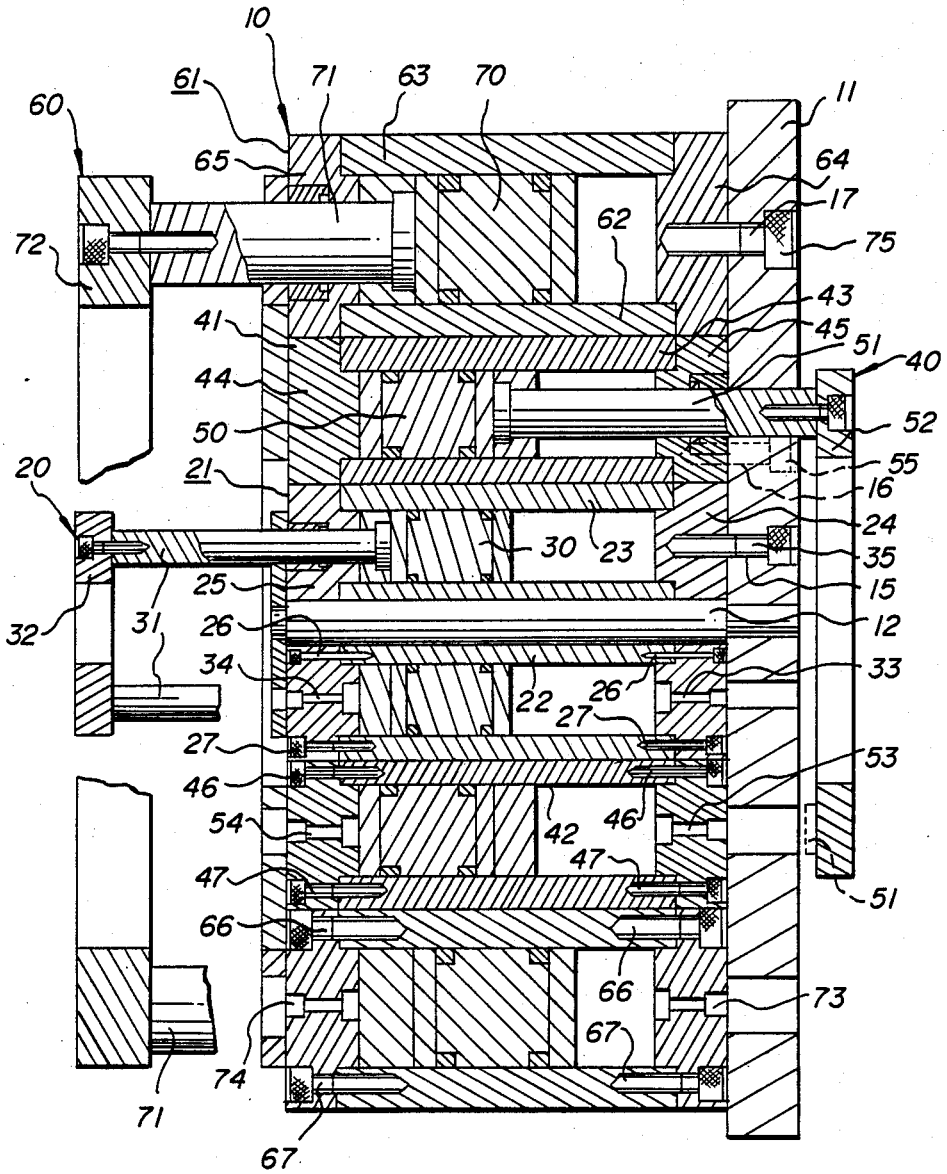
FIG. 1 is an enlarged longitudinal sectional view of a multistage cylinder actuator according to an embodiment of the present invention.

In FIG. 1, a multistage cylinder actuator 10 has a center cylinder unit 20 and a plurality of annular auxiliary cylinder units 40 and 60 which are located around the center cylinder unit 20. The first auxiliary cylinder unit 40 surrounds the center cylinder unit 20 and the second auxiliary cylinder unit 60 surrounds the first auxiliary cylinder unit 40. The number of the auxiliary cylinders are not limited to two and can be less than or more than two.

In the illustrated embodiment, the center cylinder unit 20 has an annular cylinder housing 21 to surround a center shaft 12 integrally provided on a common plate 11. Alternatively, it is also possible to provide a circular-cylindrical cylinder housing.

The annular cylinder housing 21 of the center cylinder unit 20 has an inner tube 22, an outer tube 23, a head cover 24 and a rod cover 25. An annular piston 30 is located in the annular cylinder housing 21 so as to reciprocally slide therein. The inner and outer tubes 22 and 23 define an annular cylinder space. Numerals 26 and 27 designate set bolts which are used to secure the inner and outer tubes 22 and 23 to the head cover 24 and the rod cover 25, respectively.

Figure 3:
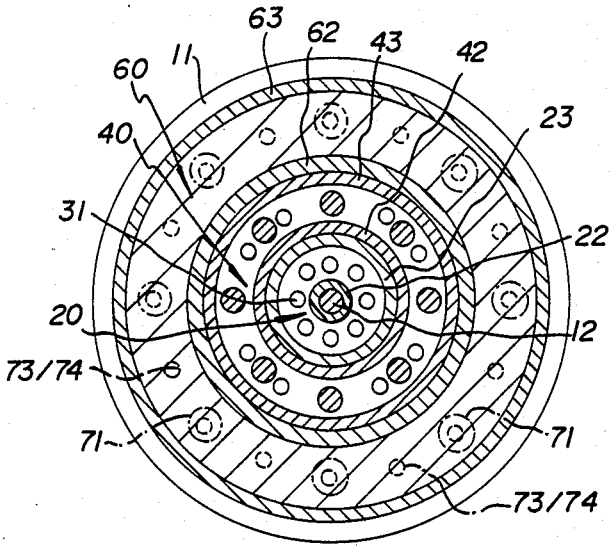
FIG. 3 is a cross sectional view of a multistage cylinder actuator shown in FIG. 1; and, FIG. 4 is a cross sectional view of a multistage cylinder actuator shown in FIG. 2.

The annular piston 30 has a plurality of piston rods 31 connected thereto which are spaced at an equiangular distance, as shown in FIG. 3. The piston rods 31 are connected at the opposite ends to a pressure plate 32 which serves as an actuator. The working fluid, for example, a pressurized oil is introduced into and discharged from the cylinder housing 21 through inlets and outlets 33 and 34 which are provided on the head cover 24 and the rod cover 25 and which are spaced at an equiangular distance, respectively.

The center cylinder unit 20 is removably connected to the common plate 11 by a set bolt 35 through a threaded hole 15 of the common plate 11.

The first annular cylinder unit 40 is located on the outer periphery of the center cylinder unit 20. The first annular cylinder unit 40 has an annular cylinder 41 having an inner tube 42, an outer tube 43, a head cover 44 and a rod cover 45. An annular piston 50 is slidably inserted in the cylinder housing of the annular cylinder 41 to reciprocate therein. In the illustrated embodiment, the direction of the operation of the piston 50 is opposite to that of the piston 30 of the center cylinder unit 20. The piston 50 has piston rods 51 connected thereto which are connected at their opposite ends to a pressure plate 52.

Numerals 53 and 54 designate inlet and outlet ports of the working fluid (e.g. pressurized oil) which is introduced into and discharged from the cylinder housing of the first auxiliary cylinder unit 40, respectively. The first auxiliary cylinder unit 40 is removably connected to the common plate 11 by set bolts 55 through mounting holes 16 of the common plate 11.

The second auxiliary cylinder unit 60 is concentrically located on the outer periphery of the first auxiliary cylinder unit 40.

The second auxiliary cylinder unit 60 has an annular cylinder 61 having an inner tube 62, an outer tube 63, a head cover 64 and a rod cover 65, similar to the first auxiliary cylinder unit 40. An annular piston 70 is slidably inserted in the cylinder housing of the annular cylinder 61 to reciprocate therein. In the illustrated embodiment, the direction of the operation of the piston 70 is opposite to that of the piston of the first auxiliary cylinder unit 40 and is same as that of the center cylinder unit 20. The piston 70 has piston rods 71 connected thereto which are connected at their opposite ends to a pressure plate 72.

Numerals 73 and 74 designate inlet and outlet ports of the working fluid (e.g. pressurized oil) which is introduced into and discharged from the cylinder housing of the second auxiliary cylinder unit 60, respectively. The second auxiliary cylinder unit 60 is removably connected to the common plate 11 by set bolts 75 through mounting holes 17 of the common plate 11.

It should be appreciated that it is possible to provide a third auxiliary cylinder unit which is concentrically located around the outer periphery of the second auxiliary cylinder unit 60, and fourth, fifth, . . . auxiliary cylinder units which are successively and concentrically located around adjacent inner auxiliary cylinder units, as mentioned before.

The center cylinder unit 20, and the second and third auxiliary cylinder units 40 and 60 are detachably attached to the comon plate 11, as mentioned above, and accordingly, they can be optionally and independently removed.

Figure 2:
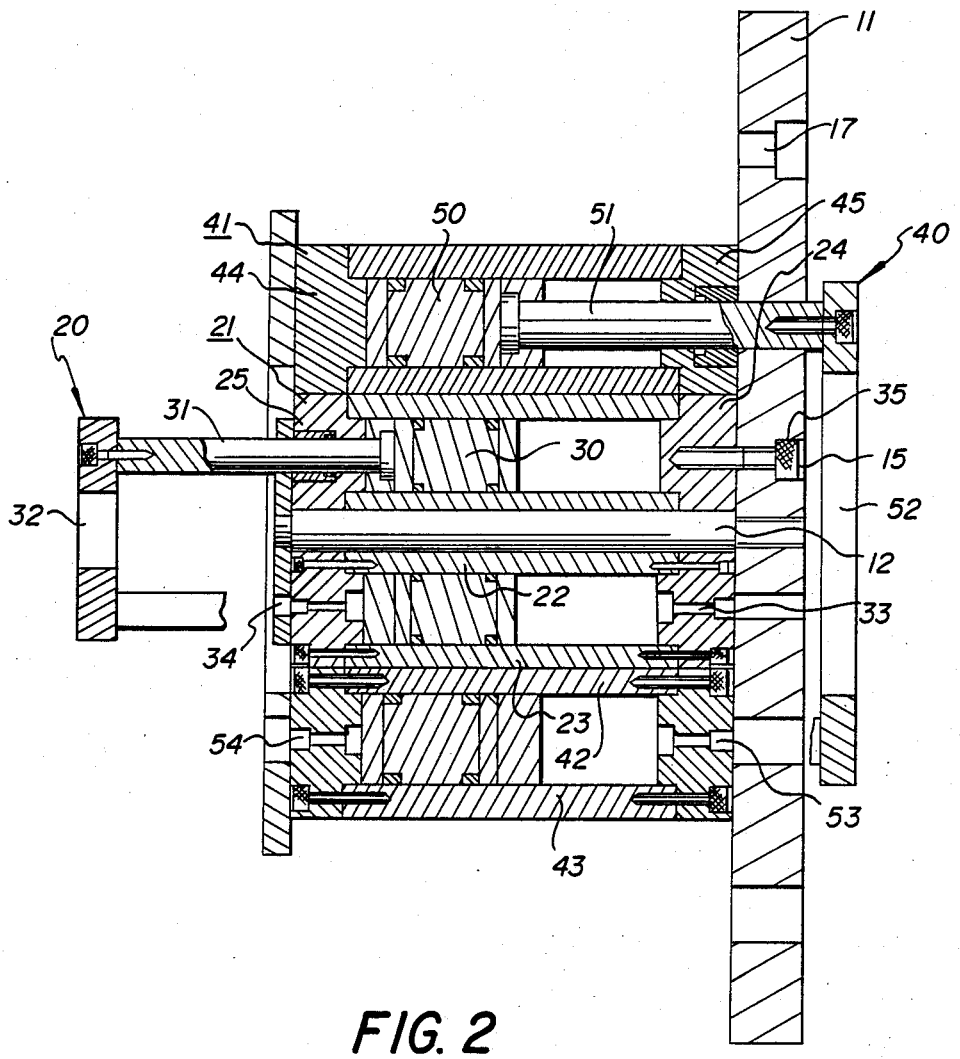
FIG. 2 is an enlarged longitudinal sectional view of a multistage cylinder actuator with a removed second cylinder, according to the present invention.
Figure 4:
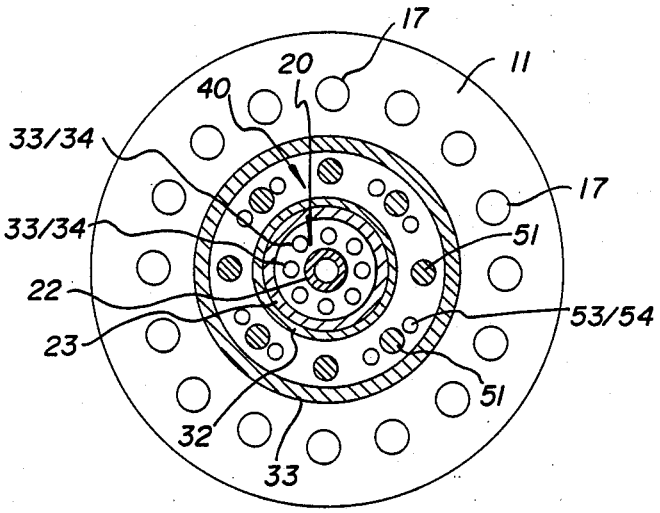

FIGS. 2 and 4 show a modified arrangement in which the second auxiliary cylinder unit 60 is removed. As can be seen from FIGS. 2 and 4, it is possible to remove the first auxiliary cylinder unit 40 and even the center cylinder unit 20, if unnecessary.

As can be understood from the above discussion, according to the present invention, the center cylinder unit and a selected number of auxiliary cylinder units can be detachably connected to a single common plate.

Furthermore, according to the present invention, since the center cylinder unit and the auxiliary cylinder units independently operate, it is possible to optionally and independently set and adjust the direction of the operation of the cylinder units and the value of pressure of the working fluid in order to produce desired output pressures of the actuator. It is also possible to optionally set the operation sequence of the cylinder units.

A plurality of piston rods which are concentrically located on the same imaginary circles contribute not only to the prevention of an accidental undesirable angular displacement of the associated pistons, but also to a realization of a small multistage cylinder actuator. Namely, in the prior art, the piston rod becomes large as the piston is large, but in the present invention, a plurality of piston rods having a relatively small diameter can be provided for such a large piston, resulting in a small cylinder unit. This also results in a decreased tolerance of the components of the cylinder actuator.

The multistage cylinder actuator according to the present invention can be advantageously used to actuate a tool, an apparatus or equipment in which a predetermined sequence of operations is necessary.

I claim:

1. A multistage cylinder actuator comprising a center cylinder unit and at least one annular auxiliary cylinder unit which is concentrically located around the center cylinder unit, each of said cylinder units including a cylinder housing removably attached to a common plate and a piston slidably mounted for reciprocating movement internally of the cylinder housing, said piston slidably mounted internally of said auxiliary cylinder unit is a annular piston, a plurality of piston rods concentrically located relative to said center cylinder unit connect said annular piston to a pressure plate, and means for independently operating each of said pistons.

2. A multistage cylinder actuator according to claim 1, wherein each of said cylinder housings has a plurality of inlet ports and outlet ports for supplying a working fluid as means for independently operating each of said pistons.

3. A multistage cylinder actuator according to claim 2, wherein said inlet ports and outlet ports for each cylinder housing are located at equiangular distances.

4. A multistage cylinder actuator according to claim 1, wherein at least two pistons of said cylinder units are operative by said means to more in different directions of operation.

5. A multistage cylinder actuator comprising a center cylinder unit and a plurality of annular auxiliary cylinder units which are concentrically located around the center cylinder unit and which are removably attached to a common plate so as to independently operate.

6. A multistage cylinder actuator according to claim 2, wherein each of said auxiliary cylinder units has a cylinder and a piston which is reciprocally inserted in the cylinder.

7. A multistage cylinder actuator according to claim 6, wherein each of said auxiliary cylinder units has a plurality of piston rods which are concentrically located on a same imaginary circle.

8. A multistage cylinder actuator according to claim 7, wherein each of said auxiliary cylinder units has a pressure plate to which the associated piston rods are connected.

9. A multistage cylinder actuator comprising a center cylinder unit and at least one annular auxiliary cylinder unit which is concentrically located around the center cylinder, said at least one annular auxiliary cylinder unit is removably attached to a common plate so as to operate independently of said center cylinder unit, said center cylinder unit has a cylinder and a piston which is reciprocally inserted in the cylinder and said center cylinder unit has a plurality of piston rods which are concentrically located on a same imaginary circle.

10. A multistage cylinder actuator according to claim 9, wherein said center cylinder unit has a pressure plate to which the piston rods are connected.

* * * * *